United States Patent [19]

O'Neill

[11] Patent Number: 4,940,112

[45] Date of Patent: Jul. 10, 1990

[54] HIGH PERFORMANCE FLAME AND SMOKE FOAM-BARRIER-FOAM-FACING ACOUSTICAL COMPOSITE

[76] Inventor: Justin T. O'Neill, 185 Melba St., Unit 111, P.O. Box 175, Milford, Conn. 06460

[21] Appl. No.: 368,510

[22] Filed: Jun. 20, 1989

[51] Int. Cl.[5] ..... E04B 1/82; C04B 43/00; B32B 3/06; B32B 5/32

[52] U.S. Cl. ..... 181/290; 181/288; 181/294; 428/198; 428/215; 428/286; 428/287; 428/316.6; 428/317.1; 428/319.7; 428/421; 428/473.5; 428/921

[58] Field of Search ..... 181/288, 290, 294, DIG. 1; 428/198, 215, 286, 287, 316.6, 317.1, 319.7, 421, 473.5, 921

[56] References Cited

U.S. PATENT DOCUMENTS

| | | | |
|---|---|---|---|
| 4,056,161 | 11/1977 | Allen, Jr. | 181/290 |
| 4,110,510 | 8/1978 | Oliveira | 181/294 X |
| 4,340,129 | 7/1982 | Salyers | 181/288 X |
| 4,488,619 | 12/1984 | O'Neill | 181/290 |

*Primary Examiner*—Benjamin R. Fuller
*Attorney, Agent, or Firm*—Sughrue, Mion, Zinn, Macpeak & Seas

[57] ABSTRACT

A multilayered composite having improved flammability and smoke resistance properties comprising:

(a) a flame retardant flexible polyimide film facing layer, (b) a first high temperature resistance silicone adhesive layer bonded to the polyimide film facing layer, (c) a first open cell polyimide foam layer bonded to the first adhesive layer, (d) a second high temperature resistance silicone adhesive layer bonded to the first open cell polyimide flame layer, (e) a fire retardant flexible silicone sheet rubber layer bonded to the second adhesive layer, (f) a third high temperature resistant silicone adhesive layer bonded to the silicone sheet rubber layer, and (g) a second open cell polyimide foam layer bonded to the third adhesive layer.

16 Claims, 6 Drawing Sheets

HIGH PERFORMANCE FLAME AND SMOKE FOAM-BARRIER-FOAM-FACING ACOUSTICAL COMPOSITE

FIELD OF THE INVENTION

This invention relates to a foam-barrier-foam-facing acoustical composite. and, in particular, this invention relates to a foam-barrier-foam-facing acoustical composite which is especially. but not exclusively. useful in aircraft. Even more particularly. this invention relates to a foam-barrier-foam-facing acoustical composite which provides vastly improved fire and smoke resistance without losing accoustical performance in noise transmission loss and noise absorption; and without adding weight penalties.

BACKGROUND OF THE INVENTION

Over the years. many composites have been developed for reducing loud noise such as noise from heavy machinery, and engine noise from trucks and aircraft.

For example, U.S. Pat. No. 4,056,161, discloses a foam-barrier-wear layer composition which provides noise transmission loss. The outer wear layer can be polyvinyl chloride reinforced with fabric The foam layer can be a low density polyester based polyurethane foam having open cells or pores. The intermediate high density barrier layer comprises a vinyl plastisol composition with a particulate material such as barium sulfate particles dispersed therein. The sound barrier layer also acts as a bonding layer for adhering both the outer layer and the foam layer. This product is used for tractor cab mats, fire wall barriers, headliners. etc.. on heavy equipment vehicles as well as for pipe wrap.

U.S. Pat. No. 4,110,510 discloses a sound barrier material comprised of a polyvinyl chloride impregnated fiber sheet or mat having a rubbery coating of a barium sulfate containing chlorinated polyethylene on each side. The fiber sheet or mat is preferably fiberglass. A foam. preferably polyurethane. having a density of 1.5 to 2.5 pounds per cubic foot is further laminated to one of the coating layers and functions as a decoupler to the mass barrier. This type of product is typically applied to noise enclosures and as pipe wrap for in-plant retrofit.

U.S. Pat. No. 4,340,129 discloses a flexible acoustical laminate construction comprising a weighted polymeric laminate having a surface density of at least about 0.5 $lb/ft^2$, and, adhered thereto, a polymeric foam composition designed to have a loss factor v of at least about 0.4 at 25° C. This acoustical laminate like the two aforementioned, is a foam-barrier construction (decoupled mass) except that a highly plasticized polyvinylchloride foam is the decoupler rather than open cell polyurethane foam. This material is used, primarily. for cab liners in heavy equipment.

U.S. Pat. No. 4 488,619 discloses a foam-barrier-foam-facing acoustical composite having acoustical and flame retardant properties. The acoustical composite is a multi-layered laminated fabric composed of a flame retardant polyvinyl fluoride facing layer, a fire resistant acrylic adhesive layer bonded to the polyvinyl fluoride facing layer, a first polyimide open cell foam layer bonded to the adhesive layer. a noise barrier layer bonded to the first polyimide open cell foam layer and a second polyimide open cell foam layer bonded to the noise barrier layer.

Previous to August. 1988. the Federal Aviation Administration had regulated, under Federal Aviation Regulation No. (FAR) 25.853, flame requirements for interior materials of FAA certified aircraft. This requirement was a vertical flame test whereby the specimen is exposed vertically to a flame (for 12 seconds under FAR 25.853(b), or 60 seconds under FAR 25.853(a)) and removed.

The average burn length could not exceed 8 inches and the average flame time after removal of the flame source could not exceed 15 seconds. Drippings from the test specimen could not continue for more than an average of 5 seconds after falling.

In August of 1988, in addition to FAR 25.853 (a) and (b), the FAA promulgated regulations requiring that interior materials of manufactured or retrofitted aircraft, in the transport category classifications, had to meet a new flame requirement which is the Ohio State University ASTM E-906 Test, FAA modified. This test records the maximum heat release rate (HRR) and maximum smoke release rate (SRR).

The Ohio State University (OSU) rate-of-heat apparatus. as standardized by the American Society of Testing and Materials (ASTM), ASTM-E-906, was determined to be the most suitable for material qualifications. All large surface materials installed above the floor in compartments occupied by the crew or passengers would have to comply with the new flammability standards. See FAA, 14 C.F.R. parts 25 and 121, Improved Flammability Standards for Materials Used in the Interiors of Transport Category Airplane Cabins: Federal Register, Volume 53. No. 165 (August 25. 1988).

The Federal Register indicates the FAA modifications to the OSU ASTM-E-906 test apparatus. First, 5 thermocouples are used in the thermopile rather than the ASTM E-906 3 thermocouples for more accurate temperature measurement.

Second, a slotted metal frame that reduces the mass of metal in the frame holding the specimen is used for minimizing the heat sink character of the non-slotted metal frame of the E-906 apparatus.

The FAA modifications to the test apparatus method were initiated to reduce the variation in test result values from test to test. (The Ohio State E-906 test was giving 18–20% test result variations while the FAA amended E-906 test reduced test result variations to 6–7%.)

Interior materials of these new or retrofit aircraft, in addition to having to comply with FAR 25.853, would also have to achieve a 100 or less maximum heat release (HRR) of 2 minutes, and at peak when tested to the FAA modified Ohio State University ASTM E-906 test. (FAA OSU ASTM E-906)

In August of 1990. the FAA requirement will tighten to 65 or less maximum heat release (HRR) and will have a smoke density (Ds) of less than 200 when tested to National Bureau of Standards Smoke Chamber, ASTM F814-83.

Present fire block acoustical composites on the market for aircraft noise suppression cannot meet the recent FAA OSU ASTM E-906 flame requirement.

An improved fire resistant acoustical composite needs to be invented to pass the newly regulated FAA flame requirements.

SUMMARY OF THE INVENTION

Accordingly. it is an object of this invention to provide a foam-barrier-foam-facing acoustical composite which has superior flammability and smoke resistance in order to pass the newly regulated FAA flame requirements.

A further object of this invention is to provide a foam-barrier-foam-facing acoustical composite which is suitably lightweight for use in aircraft.

An even further object of this invention is to provide a flexible foam-barrier-foam-facing acoustical composite which does not lose any performance in noise transmission loss or noise absorption.

The above objects are met by providing a multi-layered composite having improved flammability and smoke resistance retardant properties comprising:

(a) a flame retardant flexible polyimide film facing layer;
(b) a first high temperature resistant silicone adhesive layer bonded to the polyimide film facing layer;
(c) a first open cell polyimide foam layer bonded to the first adhesive layer;
(d) a second high temperature resistant silicone adhesive layer bonded to the first open cell polyimide foam layer;
(e) a fire retardant flexible silicone sheet rubber layer bonded to the second adhesive layer;
(f) a third high temperature resistant silicone adhesive layer bonded to the silicone flexible sheet rubber layer; and
(g) a second open cell polyimide foam layer bonded to the third adhesive layer.

DETAILED DESCRIPTION OF THE INVENTION

The invention will now be described in detail with reference to the figures where appropriate.

Figure 4:
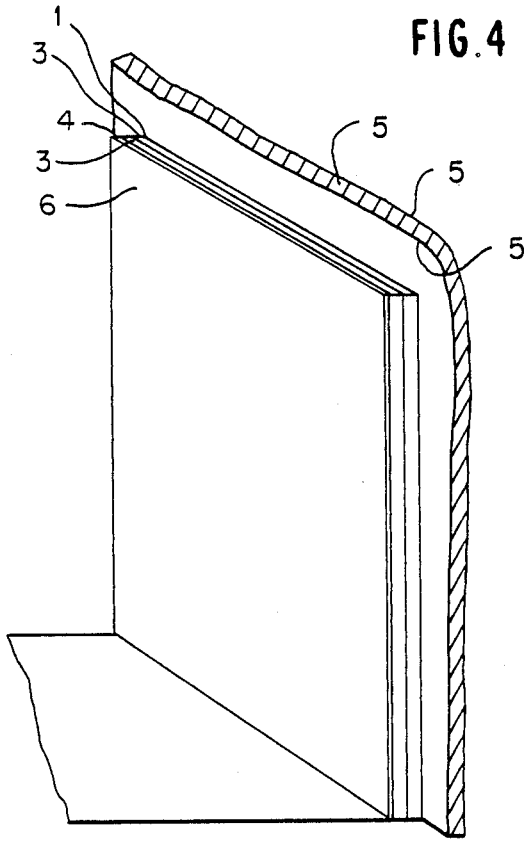
FIG. 4 is a schematic view of the acoustical composite of the present invention positioned in the aircraft.

FIG. 4 shows the application of the acoustical composite to the aircraft interior. The unfaced polyimide open cell foam layer side is the inside layer of the composite. i.e.. the layer farthest from the noise source. and serves to decouple the flexible silicone noise barrier. The faced (polyimide film) polyimide open cell foam layer. closest to the noise source and aircraft skin. functions as a noise absorber. The polyimide film facing provides moisture and oil vapor barrier protection for the foam. and may or may not touch the aircraft skin.

The foam-barrier-foam-facing acoustical composite is preferably bonded to the rigid interior trim panel 6 or cana be bonded to the interior of the aircraft skin 5, filling the cavity between the trim panel and the inside of the aircraft skin. Preferably. the acoustical composite is adhered to the interior trim panel. The flexible polyimide film facing layer side of the composite faces the aircraft skin and functions as an impervious membrane keeping oil out of the noise absorbing foam.

The foam-barrier-foam-facing acoustical composite can be adhered to the interior trim panel by means of a contact adhesive or a pressure sensitive adhesive by the release paper being pulled away from the pressure sensitive adhesive and the acoustical composite being pressed on to the trim panel by hand or roller pressure.

Figure 1:
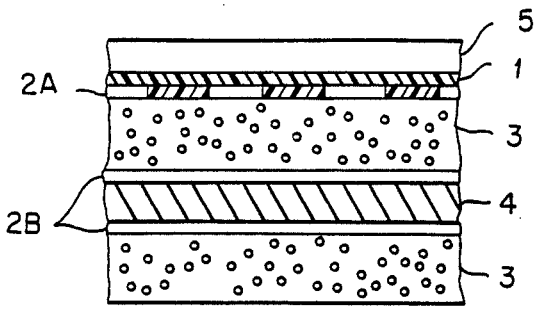
FIG. 1 is a schematic cross-sectional view of one embodiment of the acoustical composite of the present invention.

One embodiment of the foam-barrier-foam-facing acoustical composite of the present invention is shown in detail in FIG. 1. In FIG. 1. like numerals designate like elements.

The flame retardant flexible polyimide film facing layer 1 can be any conventional polyimide film that is light weight and thin and has flame retardant properties. The flame retardant properties must meet the FAR Part 25. App. F Test. That is. the flexible polyimide film facing layer must have a zero flame time. zero glow time, no drippings. and a vertical burn length of less than one inch. The polyimide facing layer can be unreinforced or is reinforced with fiber such as nylon fiber. However. unreinforced film is less desirable as it has a lower tensile strength.

The facing layer is preferably about 0.001 inches (0.025 mm) thick and weighs about 1.35 ounces per square yard.

In the most preferred embodiment. the polyimide facing layer is about 0.001 inch thick polyimide. flame retardant film supported with 70 denier nylon 4-by-4 yarns per inch. weighing about 1.35 ounces per square yard. A commercially available example of such a polyimide facing layer is the flexible polyimide film ORCOFILM KN-80. manufactured by Orcon Corporation.

The acoustical composite of the present invention further contains high temperature resistant silicone adhesive layers 2. The silicone adhesive may be any silicone adhesive suitable for bonding the polyimide facing layer to a polyimide foam, as long as the adhesive. when tested in a simulated composite. will pass the FAR 25.853(b) flame test by exhibiting zero flame time. no drippings and a burn length of no more than four inches. The silicone adhesive may also exhibit flame retardant properties. Keeping the adhesive as thin as possible (2 mils) helps to improve the fire resistance of the composite by reducing the mass of adhesive.

The high temperature resistant silicone adhesive layer is preferably a pressure sensitive adhesive layer. The adhesive layer is also preferred to be about 2 mil thick.

Figure 3:
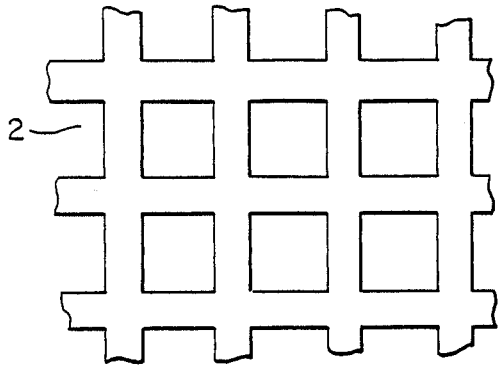
FIG. 3 is a schematic diagram of a preferred tie-down pattern of adhesive layer *2a* of the acoustical composite of the invention.

In order to have acoustical noise absorption, the adhesive layer *2a* bonding the film facing layer to the first polyimide foam layer should be disposed in a criss-crossed pattern of stripes of adhesive material as shown in FIG. 3. The criss-crossed pattern preferably comprises adhesive stripes crossing at 90 degree angles on an approximate 3-inch center distance. Most preferably the adhesive stripes are one inch wide.

The adhesive layers *2b* bonding the polyimide foam layers 3 to the flame retardant silicone sheet rubber layer 4 can be in any pattern including 100% coverage.

A commercially available adhesive for bonding the facing to the foam according to the most preferred embodiment is manufactured by Adhesives Research. Inc., under the product number AR-559.

The open cell polyimide foam layers 3 according to the present invention preferably have a density of about 0.6 to 1.0 lbs. per cubic foot. and more preferably have a density of about 0.8 lbs. per cubic foot. Further, the polyimide open cell foam layers are preferably ⅛ inch thick to 1 inch thick and more preferably ¼ inch thick to ½ inch thick.

A suitable commercially available open cell polyimide foam is Solimide TA-301. manufactured by Imi-Tech Corporation.

The present invention also contains fire retardant grade flexible silicone sheet rubber layer 4 bonded on both sides to polyimide foam layers by adhesive layers 2*b*. A fire retardant grade silicone sheet rubber can be made by adding known fire retardants. such as antimony trioxide or brominated compounds. to high temperature resistant silicone rubber compounds. The thickness of the silicone sheet rubber layer is preferably about 0.015 inch to ⅛ inch, and the weight is preferably about 20 ounces per square yard to 267 ounces per square yard.

The silicone sheet rubber layer can be unreinforced or reinforced with. for example. fiberglass fabric. The fiberglass fabric is preferably about 0.007 to 0.015 inch thick.

Suitable commercially available silicone sheet rubber layer materials are COHRlastic XA 4140 manufactured by CHR Industries. Inc.

Figure 2:
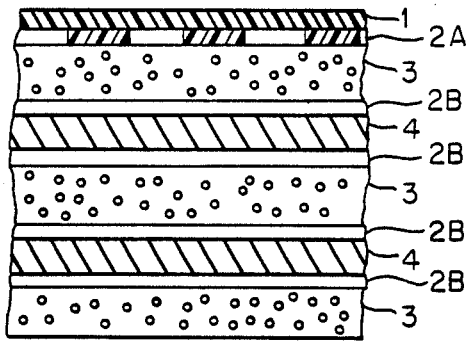
FIG. 2 is a schematic, cross-sectional view of a second embodiment of the acoustical composite of the present invention.

As shown in FIG. 1, one embodiment of the present invention comprises an acoustical composite having a foam-barrier-foam component. However. the acoustical composite of the present invention can also be comprised of additional alternating barrier-foam layers. one example of which is shown in FIG. 2.

The unexpectedly superior flame and smoke resistance of the present invention will now be demonstrated by reference to the following specific example which is not intended to limit the present invention in any way.

EXAMPLE

The flammability tests were run by an independent party in accordance with the ASTM E-906 test and the FAA modified Ohio State University ASTM E-906 test (OSU ASTM E-906. FAA modified) which is required by the Federal Aviation Administration for Aircraft Interior Material. (DOT 14 CFR Parts 25 and 121).

For both tests. all test materials were conditioned to equilibrium at 70±5° F. and 50±5% relative humidity. The method was limited to testing specimen sizes of 150 x 150 mm in the vertical mode and to products in which the test specimen taken is representative of the product in actual use.

The test method provides for a description of the behavior of materials and product specimens under a specified fire exposure. in terms of the release rate of heat and visible smoke. The change in behavior of materials and products with change in heat flux exposure can be determined by testing specimens in a series of exposures which cover a range of heat fluxes.

Release rates depend on many factors. some of which cannot be controlled. Samples that produce a surface char. layer of adherent ash, or those that are composites or laminates may not attain a steady-state release rate. Thermally thin specimens, i.e., specimens whose unexposed surface changes temperature during the test. will not attain a steady-state release rate. Therefore, release rates for the same material will depend on how the material is used, its thickness, and method of mounting. for example.

Heat release values are for the specific specimen size (exposed area) tested. Results are not directly scaleable to different exposed surface areas for some products.

The specimen to be tested is injected into an environmental chamber through which a constant flow of air passes. The specimen s exposure is determined by a radiant heat source adjusted to produce the desired radiant heat flux to the specimen. The specimen may be tested so that the exposed surface is horizontal or vertical. Combustion may be initiated by nonpiloted ignition. piloted ignition of evolved gases. or by point ignition of the surface. The changes in temperature and optical density of the gas leaving the chamber are monitored from which data on the release rates of heat and visible smoke are calculated.

The OSU ASTM E-906. FAA modified. fire test differed from the ASTM E-906 fire test in that:

(1) 5 thermocouples are used in the thermopile rather than the 3 used in the OSU ASTM E-906 fire test, for providing more accurate temperature measurement, and (2) a slotted metal frame rather than a non-slotted metal frame is used to reduce the mass of metal in the frame holding the specimen to minimize heat sink.

TERMINOLOGY $K_h$: $K_h$ is a heat value constant for calibrating the test instrument in terms of units of kilowatts per volt.

Heat Release: Heat Release Rate (HRR) per unit area of a material or product being tested is presented in units of $kW/m^2$ (kilowatts per square meter). To obtain a subjective "feel" for this, consider that a 10 cm flame from a common butane-type lighter releases energy at a rate of about 150 watts; a 5 cm flame about 90 watts. $HRR = K_h \times$ millivolt reading/A (exposed surface area of specimen).

Smoke Release: Smoke Release Rate (SRR) is presented in units of SMOKE units/$m^2$·min where a SMOKE unit is defined as the concentration of smoke in a cubic meter of air which reduces the percent transmission of light through a one meter path to 10 percent. SMOKE=Standard Metric Optical Kinetic Emission.

Cumulative Heat Release ($kW.min/m^2$) and Cumulative Smoke Release (SMOKE/$m^2$): Over a given time period they are simply defined as the integral of the Heat and Smoke Release Rates during the time interval specified.

Slope E: Although not part of the ASTM E-906 Standard. Slope E is an attempt to quantify the ease of ignition of a test specimen. Generally speaking. the higher the number. the quicker it ignites and releases heat. The technical definition of Slope E is the slope of the line drawn from the origin of the Heat Release Rate versus Time curve tangent to the curve. Units are $kW/(m^2 \cdot seconds)$.

Flame Travel Rate: As is the case with Slope E. Flame Travel Rate (mm/min) is not a required part of ASTM E-906 because often it is difficult to determine, with very high precision. in this fire test method. Flame Travel Rate in this method is defined as the rate at which flame laterally spreads across the test specimen surface.

Two specimens of a product made by following U.S. Pat. No. 4.488.619 were constructed with the following structures:

Specimen 1

1st layer: ¼ inch thick SOLIMIDE TA-301
2nd layer: 5 mil acrylic transfer adhesive
3rd layer: ½ LB/FT² barrier flexible vinyl, barium sulfate loaded (=to EAR RWB5)
4th layer: 5 mil acrylic transfer adhesive
5th layer: ¼ inch thick SOLIMIDE TA-301.
6th layer: criss-crossed 1 inch wide transfer tape (=to 3M Y-9461)
7th layer: Orco Film AN-18.

Specimen 2

Same as Specimen 1, except
3rd layer: 1 LB/FT² (=to EAR RWB10)
5th layer: ½ inch thick SOLIMIDE TA 301.
This composite was designated "Sample 1".

Specimens 1 and 2 of Sample 1 were tested to the ASTM E-906 fire test. and the results are shown in Table I, Table II, and FIGS. 5, 6, 7 and 8.

TABLE I

ASTM E-906 RATE OF HEAT RELEASE TEST RESULTS-SAMPLE 1 SPECIMEN NUMBER 1

| | |
|---|---|
| Maximum HRR (kW/M²) | 140.1 |
| Time to max HRR (sec) | 66.0 |
| Cumulative heat release (kW · min)M² | |
| 2 minute = 109.3 | |
| 3 minute = 125.7 | |
| 5 minute = 134.8 | |
| Slope E, kW/(M² · seconds) | 7.9 |
| Maximum Smoke Release Rate (SMOKE Units/M² · min) | 225.4 |
| Time of maximum smoke release (sec) | 52.0 |
| Cumulative Smoke Release (SMOKE Unit/M²) | |
| 2 minute = 105.2 | |
| 3 minute = 116.3 | |
| 5 minute = 118.8 | |
| Mass (grams): 66.7 | |
| Thickness (mm): 15.8 | |
| Orientation: Vertical | |
| Exposure: piloted | |
| Flux level (kW/M²): 35 | |
| $K_h$: 851.6138 | |
| Air flow through apparatus (M³/min): 2.4 | |
| Ignition time (sec): 1 | |
| Comments: | |
| 45 seconds back caught on fire | |
| 90 seconds sample fell burning from the holder | |

The test record (Table I) indicates that 45 seconds into the flame test, the flame burned through the outer layer of film facing. the outer layer of ¼ inch thick polyimide foam, the flexible noise barrier layer. and into the bottom layer of polyimide foam and set it on fire. In 90 seconds. the specimen fell burning from the holder. From Table I. one can see that the product according to U.S. Pat. No. 4,488,619 would not pass the newly instituted FAA flame requirements.

Figure 5:
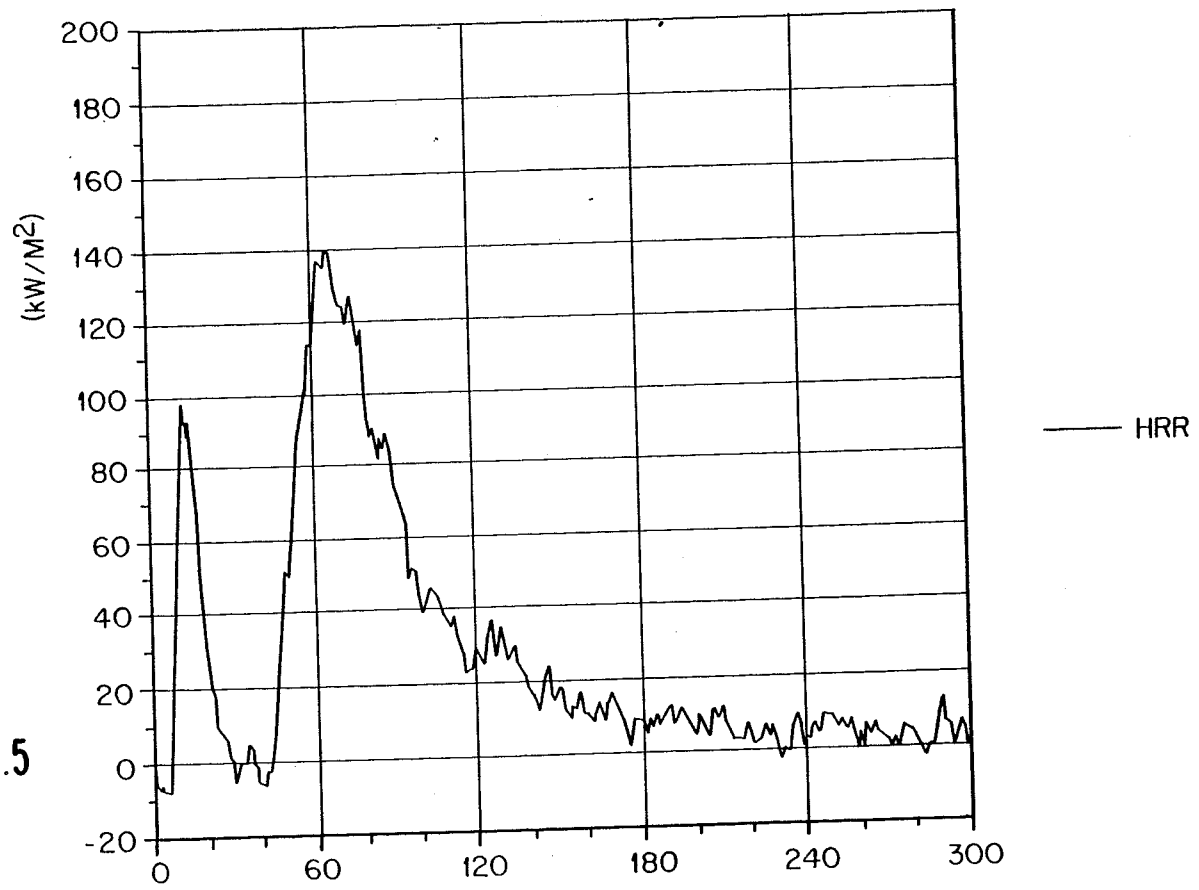
FIGS. 5 and 7 are graphic representations comparing Heat Release Rate ($kW/M^2$) vs. Time (sec.) for composites tested by the OSU ASTM E-906 (FAA Modified) Test.
Figure 6:
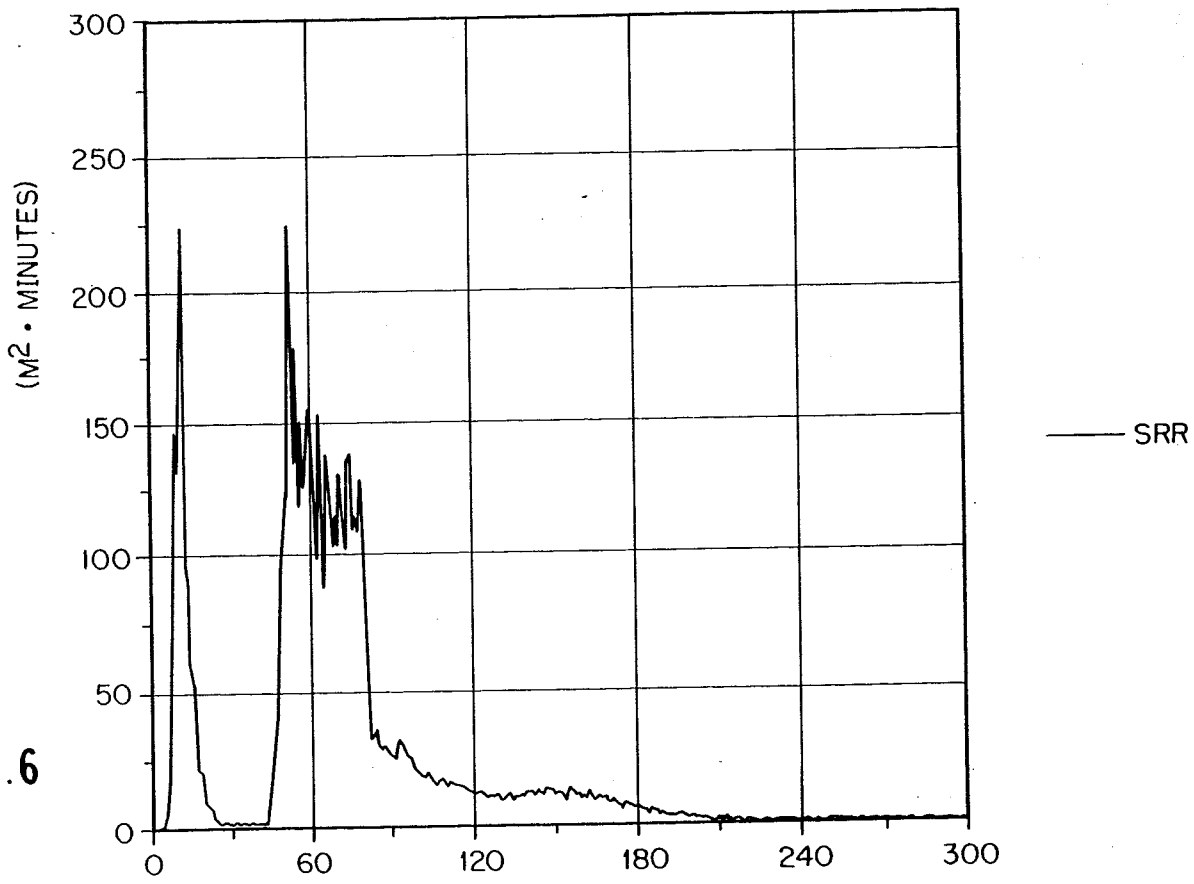
FIGS. 6 and 8 are graphic representations comparing Smoke Release Rate (SMOKE Units/$M^2$. min) vs. Time (sec.) for the same composites as in FIGS. 5 and 7 respectively.

FIG. 5 indicates graphically the Heat Release Rate which peaked at 140.1 kW/M² which is well above the Maximum Heat Release Rate of 65 kW/M² set by the FAA, effective August 1992. FIG. 6 indicates graphically the Smoke Release Rate which peaked at 225.4 SMOKE Units/(M²·min ). above the maximum Smoke Release Rate of 100 initially proposed by the FAA.

Figure 7:
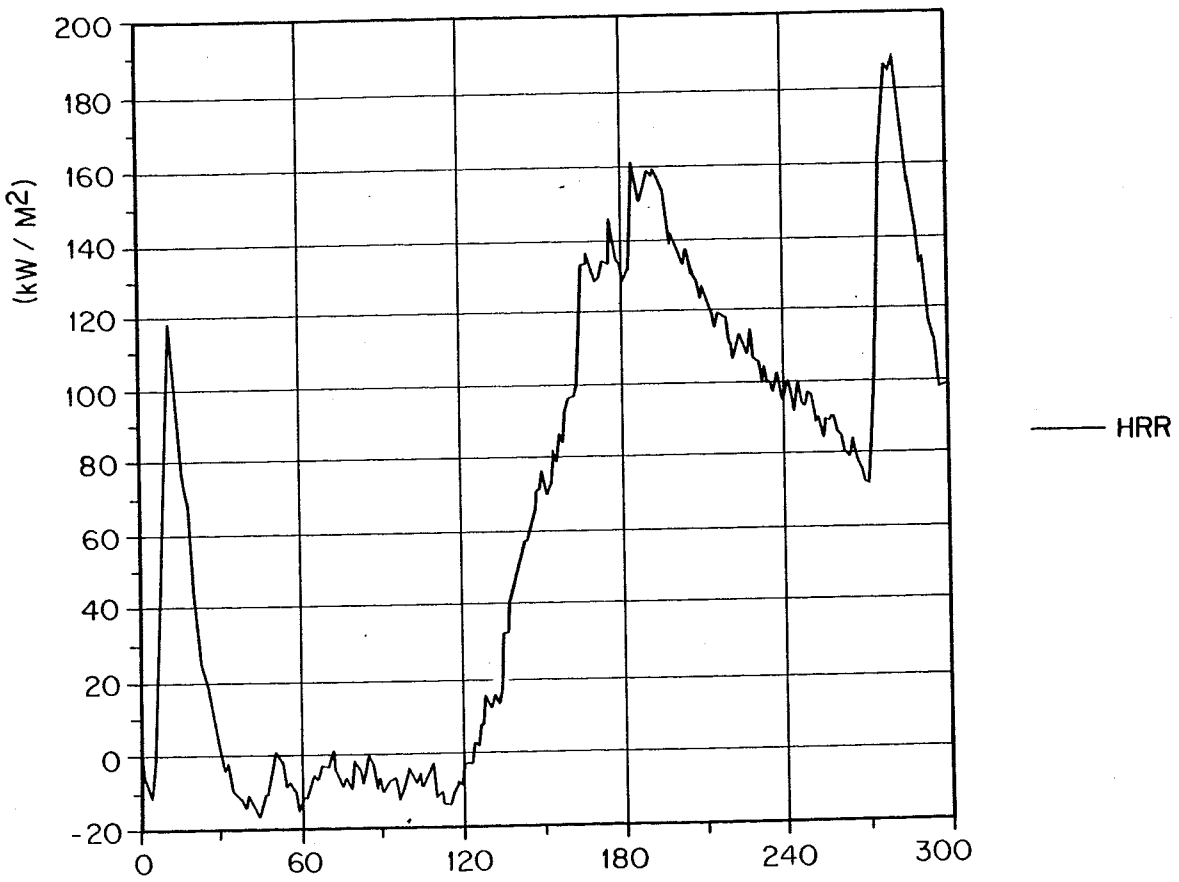
Figure 8:
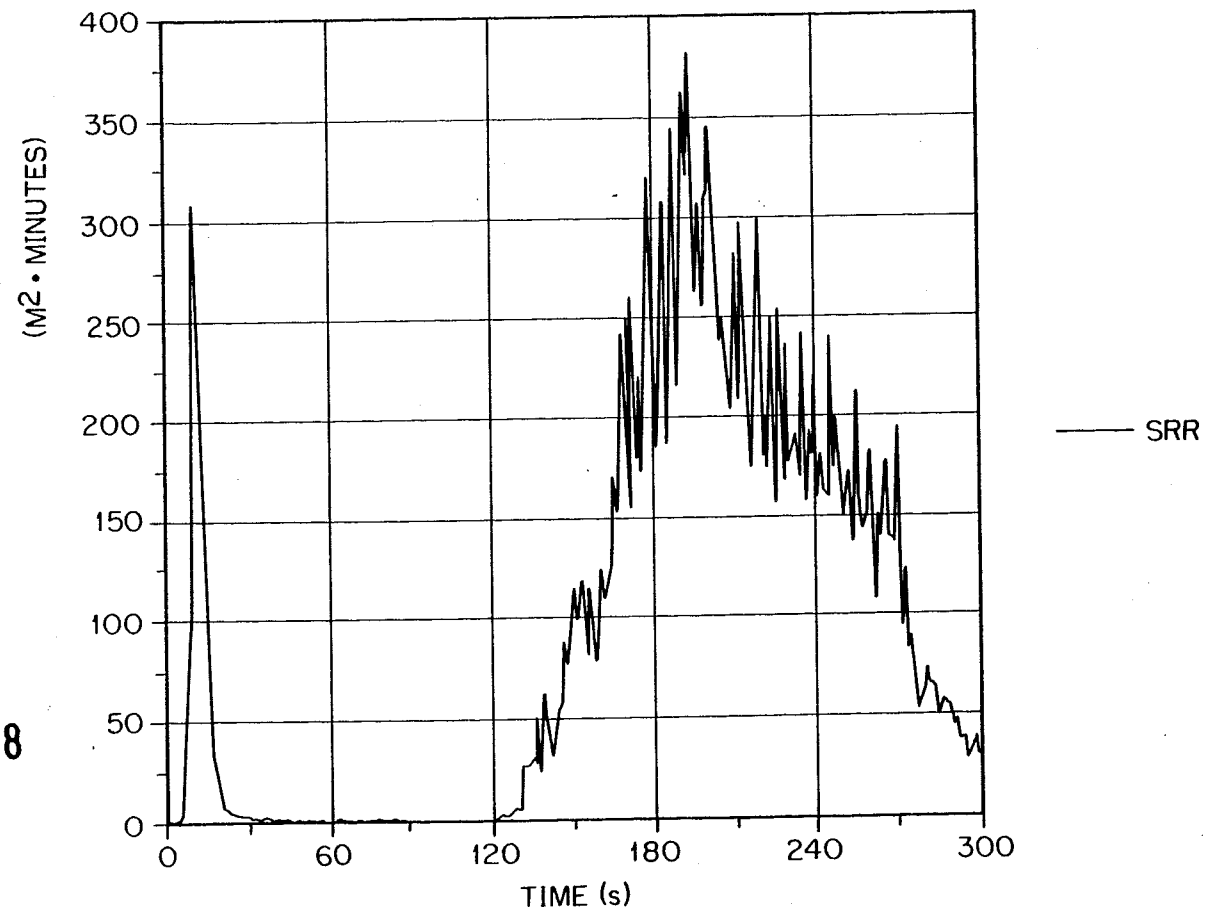

Also the test record (Table II) for specimen 2 indicates that 123 seconds into the flame test the sample re-ignited and after 280 seconds. the sample deformed and fell from the holder. FIG. 7 indicates graphically the high Heat Release Rate which peaked at 188.1 KW/M². FIG. 8 indicates graphically the high Smoke Release Rate which peaked at 381.8 SMOKE Units/(M²·min). Both the HRR and SRR were well above the permitted rates allowed by the FAA.

TABLE II

ASTM E-906 RATE OF HEAT RELEASE TEST RESULTS-SAMPLE 1 SPECIMEN NUMBER 2

| | |
|---|---|
| Maximum HRR (kW/M²) | 188.8 |
| Time to max HRR (sec) | 282.0 |
| Cumulative heat release (kW · min)/M² | |
| 2 minute = 5.9 | |
| 3 minute = 73.2 | |
| 5 minute = 311.1 | |
| Slope E, kW/(M² · seconds) | 9.2 |
| Maximum Smoke Release Rate (SMOKE Units/(M² · min)) | 381.8 |
| Time of maximum smoke release (sec) | 193.0 |
| Cumulative Smoke Release (SMOKE Units/M²) | |
| 2 minute = 24.3 | |
| 3 minute = 128.1 | |
| 5 minute = 476.9 | |
| Mass (grams): 120.5 | |
| Thickness (mm): 22 | |
| Orientation: Vertical | |
| Exposure: piloted | |
| Flux level (kW/M²): 35 | |
| $K_h$: 851.6138 | |
| Air flow through apparatus (M³/min): 2.4 | |
| Ignition time (sec): 1 | |
| Comments: | |
| 123 sec sample re-ignited. | |
| 280 sec sample deformed and fell from holder. | |

Flexible silicone sheet rubber barriers were considered in place of flexible barium sulfate loaded vinyl noise barriers hoping to improve fire resistance.

Also. a new film facing to the acoustical composite was provided hoping to provide surface fire resistance. A .001 inch thick yarn reinforced flexible polyimide film was utilized in lieu of the fire retardant polyvinyl fluoride flexible film facing.

The composite constructed had the following structure:

1st layer: ¼ inch thick SOLIMIDE TA-301 polyimide open cell foam
2nd layer: 5 mil acrylic transfer adhesive
3rd layer: approximately ½ LB/FT² flexible silicone rubber, unreinforced
4th layer: 5 mil acrylic transfer adhesive
5th layer: ¼ inch SOLIMIDE TA-301 polyimide open cell foam
6th layer: 2 mil equal to 3MY-9461, 1 inch wide criss-crossed on 3 inch center distance.
7th layer: 0.001 inch thick flexible yarn reinforced polyimide film This composite was designated Sample 2.

Sample 2 was tested to the ASTM E-906 fire test, and the results are shown in Table III.

TABLE III

ASTM E-906 RATE OF HEAT RELEASE TEST RESULTS SAMPLE 2

| | |
|---|---|
| Maximum HRR (kW/M²) | 128.7 |
| Time to max HRR (sec) | 301.0 |
| Cumulative heat release (kW · min)/M² | |
| 1 minute = −12.9 | |
| 2 minute = −26.6 | |
| 3 minute = −28.0 | |
| 4 minute = 31.2 | |
| 5 minute = 145.7 | |
| 6 minute = 259.1 | |
| 7 minute = 339.6 | |
| 8 minute = 388.9 | |
| 9 minute = 418.3 | |
| 10 minute = 434.0 | |
| Slope E, kW/(M² · seconds) | 0.5 |
| Slope E time(s): | 255 |
| Maximum Smoke Release Rate | 279.8 |

TABLE III-continued

| ASTM E-906 RATE OF HEAT RELEASE TEST RESULTS SAMPLE 2 | |
|---|---|
| (SMOKE Units/($M^2$ · min) | |
| Time of maximum smoke release (sec) | 255.0 |
| Cumulative Smoke Release (SMOKE Units/$M^2$) | |
| 1 minute = | 0.1 |
| 2 minute = | 0.6 |
| 3 minute = | 20.3 |
| 4 minute = | 119.7 |
| 5 minute = | 274.0 |
| 6 minute = | 408.8 |
| 7 minute = | 492.2 |
| 8 minute = | 537.5 |
| 9 minute = | 553.0 |
| 10 minute = | 557.3 |
| Mass (grams): 80 | |
| Thickness (mm): 12 | |
| Orientation: Vertical | |
| Exposure: piloted | |
| Flux level (kW/$M^2$): 35 | |
| $K_h$: 851.6138 | |
| Air flow through apparatus ($M^3$/min): 2.4 | |
| Ignition time (sec): 1 | |

Results for Sample 2 showed improved flame resistance but also slightly higher smoke density. Again, the product used in Table III would not pass the newly regulated FAA flame requirements.

Further development was necessary. A fire retardant flexible silicone sheet rubber was used in the hope of providing an improved fire retardant noise barrier. A new fire retardant silicone pressure sensitive adhesive with improved high tack was used for bonding the polyimide foam to both sides of the fire retardant silicone flexible sheet rubber, and for bonding the flexible polyimide film facing to the polyimide foam.

The structure of the composite was as follows:

1st layer: ¼ inch thick SOLIMIDE TA-301 polyimide open cell foam

2nd layer: 2 mil high temperature resistant silicone transfer adhesive

3rd layer: ½ LB/$FT^2$ fire retardant silicone sheet rubber reinforced with fiberglass 4th layer: 2 mil high temperature resistant silicone transfer adhesive 5th layer: ¼ inch thick SOLIMIDE TA-301 polyimide open cell foam 6th layer: 2 mil high temperature resistant silicone transfer adhesive 1 inch wide criss-crossed pattern on 3 inch center distance 7th layer: 0.001 inch thick yarn reinforced polyimide flexible film The composite was designated "Sample 3".

Sample 3 was tested to the ASTM E-906 fire test, and the results are shown in Table IV.

TABLE IV

| ASTM E-906 RATE OF HEAT RELEASE TEST RESULTS - SAMPLE 3 | |
|---|---|
| Maximum HRR (kW/$M^2$) | 74.5 |
| Time to max HRR (sec) | 196.0 |
| Cumulative heat release (kW · min)/$M^2$ | |
| 1 minute = | −7.9 |
| 2 minute = | −8.1 |
| 3 minute = | 46.7 |
| 4 minute = | 102.8 |
| 5 minute = | 129.5 |
| 6 minute = | 146.0 |
| 7 minute = | 152.6 |
| 8 minute = | 152.6 |
| 9 minute = | 152.6 |
| 10 minute = | 152.6 |

TABLE IV-continued

| ASTM E-906 RATE OF HEAT RELEASE TEST RESULTS - SAMPLE 3 | |
|---|---|
| Slope E, kW/($M^2$ · seconds) | 0.4 |
| Slope E time(s): | 171 |
| Maximum Smoke Release Rate (SMOKE Units/($M^2$ · min) | 99.6 |
| Time of maximum smoke release (sec) | 183.0 |
| Cumulative Smoke Release (SMOKE Units/$M^2$) | |
| 1 minute = | 2.8 |
| 2 minute = | 10.5 |
| 3 minute = | 69.8 |
| 4 minute = | 119.1 |
| 5 minute = | 133.3 |
| 6 minute = | 136.0 |
| 7 minute = | 136.2 |
| 8 minute = | 136.2 |
| 9 minute = | 136.2 |
| 10 minute = | 136.2 |
| Mass (grams): 42.3 | |
| Thickness (mm): 12.5 | |
| Orientation: Vertical | |
| Exposure: piloted | |
| Flux level (kW/$M^2$): 35 | |
| $K_h$: 851.6138 | |
| Air flow through apparatus ($M^3$/min): 2.4 | |
| Ignition time (sec): 1 | |

As can be seen from the data in Table IV, extraordinary and unexpected high performance flame and smoke resistances of the composite were discovered when the composite was tested to the ASTM E-906 test. Such results are within the newly regulated FAA flame requirements.

More samples of the new acoustical composite, having the same structure as Sample 3 were prepared. The 3 samples were designated Samples 4, 5 and 6.

Samples 4. 5 and 6 were tested to the OSU ASTM E-906, FAA modified, fire test.

The results are shown in Tables V. VI and VII.

TABLE V

| OSU ASTM E-906, FAA MODIFIED, RATE OF HEAT RELEASE TEST RESULTS - SAMPLE 4 | |
|---|---|
| Maximum HRR (kW/$M^2$) | 64.3592 |
| Time to max HRR (sec) | 229 |
| Cumulative heat release (kW · min)/$M^2$ | |
| 0 minute = | −0.066 |
| .5 minute = | 2.234 |
| 1.0 minute = | 3.932 |
| 1.5 minute = | 6.155 |
| 2.0 minute = | 9.754 |
| 2.5 minute = | 17.077 |
| 3.0 minute = | 31.110 |
| 3.5 minute = | 56.192 |
| 4.0 minute = | 87.455 |
| 4.5 minute = | 115.845 |
| 5.0 minute = | 137.671 |
| Slope E, kW/($M^2$ · seconds): | 0.6782587 |
| Slope E time(s): | 10 |
| Maximum Smoke Release Rate: (SMOKE Units/($M^2$ · min) | 81.4026 |
| Time of maximum smoke release (sec): | 217 |
| Smoke Release Rate (SMOKE Units/($M^2$ · min) | |
| 0 minute = | −0.5 |
| .5 minute = | −0.5 |
| 1.0 minute = | −0.5 |
| 1.5 minute = | 0.5 |
| 2.0 minute = | 3.9 |
| 2.5 minute = | 18.8 |
| 3.0 minute = | 45.3 |
| 3.5 minute = | 78.7 |
| 4.0 minute = | 72.0 |
| 4.5 minute = | 41.1 |
| 5.0 minute = | 19.2 |

TABLE V-continued

OSU ASTM E-906,
FAA MODIFIED, RATE OF HEAT RELEASE
TEST RESULTS - SAMPLE 4

| Heat Release Rates ($kW/M^2$) | |
|---|---|
| 0 minute = | −3.9 |
| .5 minute = | 3.3 |
| 1.0 minute = | 3.9 |
| 1.5 minute = | 5.7 |
| 2.0 minute = | 9.6 |
| 2.5 minute = | 21.7 |
| 3.0 minute = | 36.8 |
| 3.5 minute = | 60.0 |
| 4.0 minute = | 62.2 |
| 4.5 minute = | 50.6 |
| 5.0 minute = | 36.6 |
| **Cumulative Smoke Release (SMOKE Units/$M^2$)** | |
| 0 minute = | −0.01 |
| .5 minute = | 3.90 |
| 1.0 minute = | 3.65 |
| 1.5 minute = | 3.55 |
| 2.0 minute = | 4.49 |
| 2.5 minute = | 9.52 |
| 3.0 minute = | 25.13 |
| 3.5 minute = | 59.34 |
| 4.0 minute = | 96.65 |
| 4.5 minute = | 125.45 |
| 5.0 minute = | 139.49 |

TABLE VI

OSU ASTM E-906,
FAA MODIFIED, RATE OF HEAT RELEASE
TEST RESULTS - SAMPLE 4

| | |
|---|---|
| Maximum HRR ($kW/M^2$) | 48.3789 |
| Time to max HRR (sec) | 246 |
| **Cumulative heat release (kW · min)/$M^2$** | |
| 0 minute = | −0.044 |
| .5 minute = | 3.377 |
| 1.0 minute = | 6.220 |
| 1.5 minute = | 8.805 |
| 2.0 minute = | 13.244 |
| 2.5 minute = | 19.527 |
| 3.0 minute = | 31.369 |
| 3.5 minute = | 49.588 |
| 4.0 minute = | 72.061 |
| 4.5 minute = | 94.657 |
| 5.0 minute = | 114.264 |
| Slope E, kW/($M^2$ · seconds): | 0.9547336 |
| Slope E time(s): | 11 |
| Maximum Smoke Release Rate (SMOKE Units/($M^2$ · min): | 56.8457 |
| Time of maximum smoke release (sec): | 219 |
| **Smoke Release Rate (SMOKE Units/($M^2$ · min)** | |
| 0 minute = | 0.0 |
| .5 minute = | 2.9 |
| 1.0 minute = | −0.5 |
| 1.5 minute = | 0.0 |
| 2.0 minute = | 2.4 |
| 2.5 minute = | 15.3 |
| 3.0 minute = | 34.0 |
| 3.5 minute = | 45.1 |
| 4.0 minute = | 49.6 |
| 4.5 minute = | 37.6 |
| 5.0 minute = | 21.6 |
| **Heat Release Rates ($kW/M^2$)** | |
| 0 minute = | −2.6 |
| .5 minute = | 7.7 |
| 1.0 minute = | 4.4 |
| 1.5 minute = | 6.1 |
| 2.0 minute = | 9.0 |
| 2.5 minute = | 18.8 |
| 3.0 minute = | 29.6 |
| 3.5 minute = | 43.3 |
| 4.0 minute = | 46.2 |
| 4.5 minute = | 42.7 |
| 5.0 minute = | 34.6 |
| **Cumulative Smoke Release (SMOKE Units/$M^2$)** | |
| 0 minute = | 0.0 |

TABLE VI-continued

OSU ASTM E-906,
FAA MODIFIED, RATE OF HEAT RELEASE
TEST RESULTS - SAMPLE 4

| | |
|---|---|
| .5 minute = | 4.83 |
| 1.0 minute = | 4.81 |
| 1.5 minute = | 4.77 |
| 2.0 minute = | 5.21 |
| 2.5 minute = | 8.71 |
| 3.0 minute = | 21.42 |
| 3.5 minute = | 43.34 |
| 4.0 minute = | 69.16 |
| 4.5 minute = | 90.76 |
| 5.0 minute = | 106.01 |

TABLE VII

OSU ASTM E-906,
FAA MODIFIED, RATE OF HEAT RELEASE
TEST RESULTS - SAMPLE

| | |
|---|---|
| Maximum HRR ($kW/M^2$) | 51.2247 |
| Time to max HRR (see) | 233 |
| **Cumulative heat release (kW · min)/$M^2$** | |
| 0 minute = | −0.091 |
| .5 minute = | 3.077 |
| 1.0 minute = | 4.169 |
| 1.5 minute = | 5.301 |
| 2.0 minute = | 7.640 |
| 2.5 minute = | 13.923 |
| 3.0 minute = | 27.364 |
| 3.5 minute = | 49.015 |
| 4.0 minute = | 73.839 |
| 4.5 minute = | 96.552 |
| 5.0 minute = | 114.224 |
| Slope E, kW/($M^2$ · seconds): | 0.8143965 |
| Slope E time(s): | 18 |
| Maximum Smoke Release Rate (SMOKE Units/($M^2$ · min): | 63.4821 |
| Time of maximum smoke release (sec): | 209 |
| **Smoke Release Rate (SMOKE Units/($M^2$ · min)** | |
| 0 minute = | 0.0 |
| .5 minute = | 3.9 |
| 1.0 minute = | −0.5 |
| 1.5 minute = | 1.0 |
| 2.0 minute = | 5.4 |
| 2.5 minute = | 15.8 |
| 3.0 minute = | 50.2 |
| 3.5 minute = | 61.6 |
| 4.0 minute = | 55.2 |
| 4.5 minute = | 35.9 |
| 5.0 minute = | 23.6 |
| **Heat Release Rates ($kW/M^2$)** | |
| 0 minute = | −5.5 |
| .5 minute = | 7.2 |
| 1.0 minute = | 2.4 |
| 1.5 minute = | 4.4 |
| 2.0 minute = | 7.7 |
| 2.5 minute = | 18.6 |
| 3.0 minute = | 35.7 |
| 3.5 minute = | 48.8 |
| 4.0 minute = | 47.5 |
| 4.5 minute = | 39.2 |
| 5.0 minute = | 31.7 |
| **Cumulative Smoke Release (SMOKE Units/$M^2$)** | |
| 0 minute = | 0.00 |
| .5 minute = | 6.51 |
| 1.0 minute = | 6.55 |
| 1.5 minute = | 6.59 |
| 2.0 minute = | 8.10 |
| 2.5 minute = | 13.22 |
| 3.0 minute = | 30.03 |
| 3.5 minute = | 58.85 |
| 4.0 minute = | 87.79 |
| 4.5 minute = | 111.75 |
| 5.0 minute = | 126.70 |

The results shown in Tables V. VI and VII are unexpectedly better than those from previous tests performed in accordance with the ASTM E-906 test which was not FAA modified.

The average maximum heat and smoke release rates (Tables V-VII) were as follows:

Maximum heat release rate 54.6 average.

Maximum smoke release rate 67.2 average.

As can be seen from the above data from the OSU ASTM E-906 test, FAA modified. the results indicate high product performance in resistance to flame and smoke. The Heat Release Rate factors were far below the new FAA requirement of 100 or less and well below future 1990 FAA requirements of 65 or less.

While the invention has been described in detail with reference to specific embodiments thereof, it will be apparent to one skilled in the art that various changes and modifications can be made therein without departing from the spirit and scope thereof.

What is claimed is:

1. A multilayered composite having improved flammability and smoke resistance properties comprising:

(a) a flame retardant flexible polyimide film facing layer, (b) a first high temperature resistant silicone adhesive layer bonded to said polyimide film facing layer, (c) a first open cell polyimide foam layer bonded to said first adhesive layer, (d) a second high temperature resistant silicone adhesive layer bonded to said first open cell polyimide flame layer, (e) a fire retardant flexible silicone sheet rubber layer bonded to said second adhesive layer, (f) a third high temperature resistant silicone adhesive layer bonded to said silicone sheet rubber layer, and (g) a second open cell polyimide foam layer bonded to said third adhesive layer.

2. The composite of claim 1. wherein said flexible polyimide film facing layer is about 0.001 inches thick.

3. The composite of claim 1. wherein said flexible polyimide film facing layer is reinforced with fiber.

4. The composite of claim 3, wherein said fiber is nylon fiber.

5. The composite of claim 1, wherein said flexible polyimide film facing 1.ayer has a weight of about 1.35 oz/sq yd.

6. The composite of claim 1, wherein said first silicone adhesive layer is disposed in a criss-crossed pattern of stripes of adhesive material.

7. The composite of claim 6, wherein said criss-crossed pattern comprises adhesive stripes crossing at 90° angles on a 3-inch center distance.

8. The composite of claim 1, wherein said silicone adhesive layers are 2 mil thick.

9. The composite of claim 1, wherein said silicone adhesive layers are pressure sensitive adhesive layers.

10. The composite of claim 1, wherein said open cell polyimide foam layers have a density of about 0.6 to 1 lb. per cubic foot.

11. The composite of claim 9, wherein said open cell polyimide foam layers have a density of about 0.8 lbs. per cubic foot.

12. The composite of claim 11, wherein said open cell polyimide foam layers are about ⅛ to 1 inch thick.

13. The composite of claim 1, wherein said flexible silicone sheet rubber layer is about 0.015 to ⅛ inch thick.

14. The composite of claim 1, wherein said flexible silicone sheet rubber layer has a fiberglass fabric reinforcement.

15. The composite of claim 14, wherein said fiberglass fabric is about 0.007 to 0.015 inch thick.

16. The composite of claim 1. wherein said flexible silicone sheet rubber layer has a weight in the range of from about 20 to 267 oz/yd$^2$.

* * * * *